US006011458A

United States Patent [19]

Endo et al.

[11] Patent Number: 6,011,458

[45] Date of Patent: Jan. 4, 2000

[54] LARGE-CURRENT FUSE UNIT

[75] Inventors: Takayoshi Endo; Goro Nakamura, both of Shizuoka, Japan

[73] Assignee: Yazaki Corporation, Tokyo, Japan

[21] Appl. No.: 09/268,315

[22] Filed: Mar. 16, 1999

Related U.S. Application Data

[63] Continuation of application No. 08/956,423, Oct. 23, 1997.

[30] Foreign Application Priority Data

Oct. 30, 1996 [JP] Japan ..... 8-288467

[51] Int. Cl.[7] ..... H01H 85/055; H01H 85/044; H01H 37/76

[52] U.S. Cl. ..... 337/198; 337/185; 337/166; 337/405; 337/406

[58] Field of Search ..... 337/198, 185, 337/166, 405, 406, 163, 182, 186, 229, 401, 183, 184

[56] References Cited

U.S. PATENT DOCUMENTS

| | | | |
|---|---|---|---|
| 3,786,388 | 1/1974 | Sato | 337/269 |
| 3,931,602 | 1/1976 | Plasko | 337/163 |
| 4,184,139 | 1/1980 | Hara | 337/407 |
| 4,352,082 | 9/1982 | Barry et al. | 337/409 |
| 4,451,814 | 5/1984 | Barry et al. | 337/407 |
| 5,014,036 | 5/1991 | Komoto | 337/407 |
| 5,150,093 | 9/1992 | Gurevich | 337/163 |
| 5,192,940 | 3/1993 | Yajima et al. | 338/308 |
| 5,343,192 | 8/1994 | Yenisey | 340/639 |
| 5,406,244 | 4/1995 | Thwaites et al. | 337/163 |

FOREIGN PATENT DOCUMENTS 52-13504 11/1977 Japan .

*Primary Examiner*—Leo P. Picard
*Assistant Examiner*—Anatoly Vortman
*Attorney, Agent, or Firm*—Sughrue, Mion, Zinn Macpeak & Seas, PLLC

[57] ABSTRACT

In large-current fuse unit, a large-current fuse has a pair of terminals interconnected by a fuse element, and a housing receives the large-current fuse therein, and a temperature fuse is mounted within the housing, and is disposed in close proximity to the fuse element. The temperature fuse is melted by heat generated from the fuse element.

10 Claims, 7 Drawing Sheets

LARGE-CURRENT FUSE UNIT

This is a continuation of application Ser. No. 08/956,423 filed Oct. 23, 1997, the disclosure of which is incorporated herein by reference.

BACKGROUND OF THE INVENTION

This invention relates to a large-current fuse unit of a cartridge type used in an electric circuit in an automobile or the like, and more particularly to such a fuse unit having a temperature fuse provided in the vicinity of a fusible portion of a main fuse.

A fuse 1 of a cartridge type as shown in FIG. 5 has heretofore been used in an electric circuit of an automobile or the like. This fuse comprises a pair of terminals 3 and 3 interconnected by a fuse element 5, a housing 7 made of an insulative thermal-resistant resin and holding the terminals 3 and the fuse element 5 therein, and a transparent cover 11 closing an open top 9 of the housing 7. Terminal receiving chambers for respectively receiving the terminals 3 and 3, as well as an element receiving space communicating with these terminal receiving chambers, are formed within the housing 7. When the terminals 3 and 3 are received respectively in the terminal receiving chambers, the fuse element 5 is positioned in the element receiving space, so that whether or not the fuse element is melted can be confirmed with eyes through the transparent cover 11. When a current larger than a rating flows through the fuse element 5, the fuse element 5 is melted by heat, generated therein, to open the circuit, thereby protecting a wire and an equipment.

Generally, in the above conventional fuse, there is the correlation between an energizing current and a melting time as shown in FIG. 6. More specifically, the fusible portion is instantaneously melted by a current larger than 200% of the rating of the fuse, but the melting time is relatively long with a current less than 200% of the fuse rating since the fuse is designed to withstand a rush current. When such current as is produced upon discontinuous short-circuiting (rare short circuit) flows instead of the continuous flowing of the current, the fusible portion of the fuse element 5 repeatedly generates and dissipate heat, so that the melting time tends to become long. On the other hand, when the discontinuous short-circuiting current flows through the wire constituting the circuit, the wire fails to dissipate heat as in the fusible portion even when the current is interrupted since the wire is covered with a sheath, and therefore the temperature of the wire continues to rise because of the accumulated heat, and in the worst case, there is a possibility that the wire produces smoke.

SUMMARY OF THE INVENTION

The present invention has been made in view of the above problem, and an object of the invention is to provide a large-current fuse unit which has the function of positively breaking a circuit using a large current, at the occurrence of a short circuit, or the function of notifying the operator of such an abnormal condition.

The above object of the invention has been achieved by a large-current fuse unit characterized by the provision of a large-current fuse having a pair of terminals interconnected by a fuse element; a housing receiving the large-current fuse therein; and a temperature fuse mounted within the housing, and disposed in close proximity to the fuse element, the temperature fuse being melted by heat generated from the fuse element.

Preferably, an operating temperature of the temperature fuse is set to a value between an operating temperature of the large-current fuse and a maximum temperature which can develop in a normally-used condition of the large-current fuse.

In the large-current fuse unit of this construction, even if the large-current fuse is not melted, the temperature fuse is melted by heat generated from the large-current fuse, and in accordance with this melting signal, the circuit can be broken, or the occurrence of the abnormal condition can be transmitted to the operator.

The operating temperature of the temperature fuse is set to a value between the operating temperature of the large-current fuse and the maximum temperature which can develop in the normally-used condition of the large-current fuse, and by doing so, the temperature fuse can be melted at the time of discontinuous short-circuiting (rare short circuit) when the large-current fuse is not melted. BRIEF DESCRIPTION OF THE DRAWINGS FIG. 1 is a partly-broken side-elevational view of a large-current fuse unit of the present invention;

DETAILED DESCRIPTION OF THE INVENTION

Preferred embodiments of a large-current fuse unit of the present invention will now be described in detail with reference to the drawings.

Figure 1:
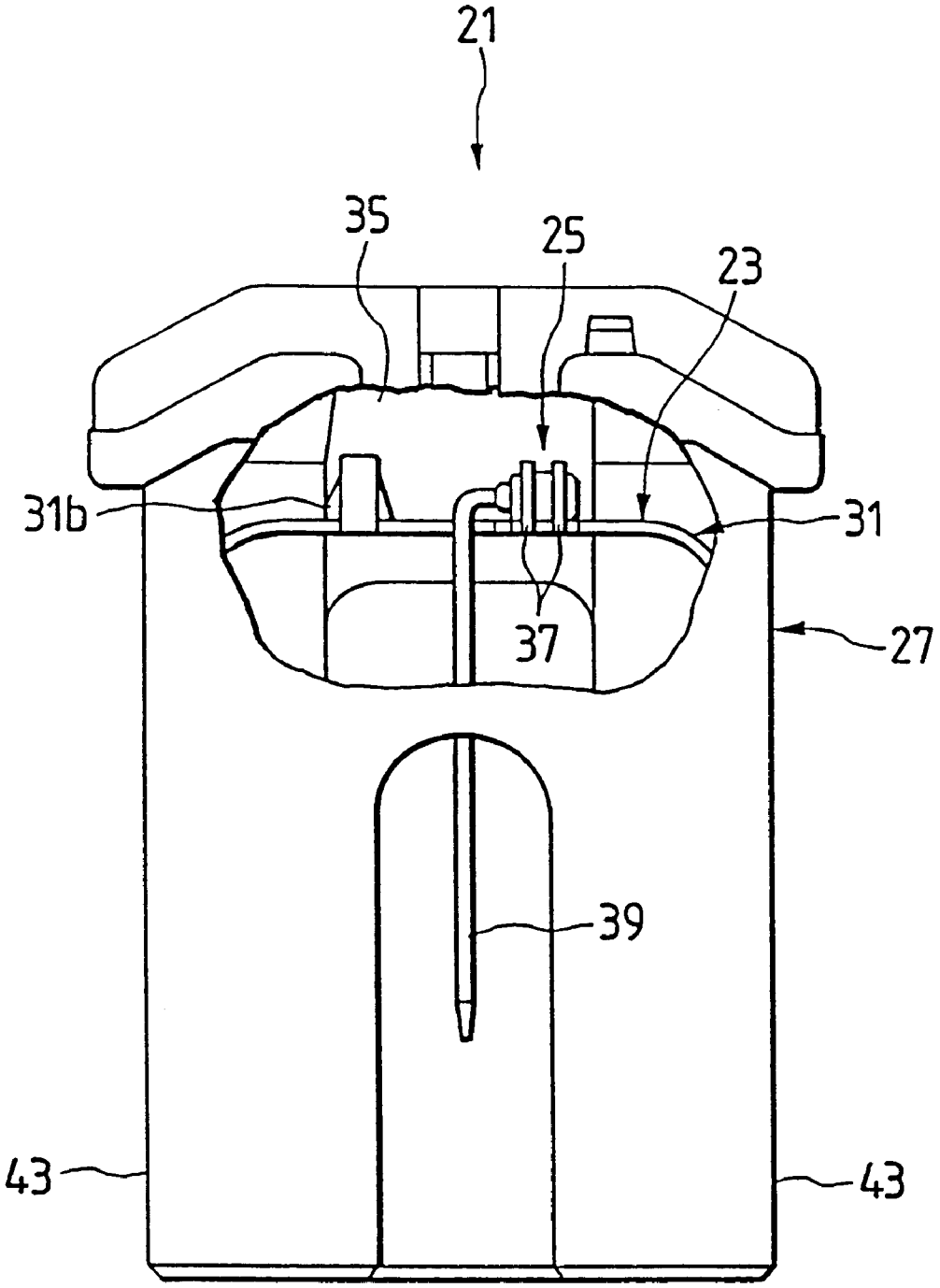
FIG. 1(A) is a partly-broken side-elevational view of a large-current fuse unit of the present invention showing a temperature fuse connected to an alarm circuit.
FIG. 1(B) is a partly-broken side-elevational view of a large-current fuse unit of the present invention showing the temperature fuse connected to a forced breaking circuit.
Figure 2:
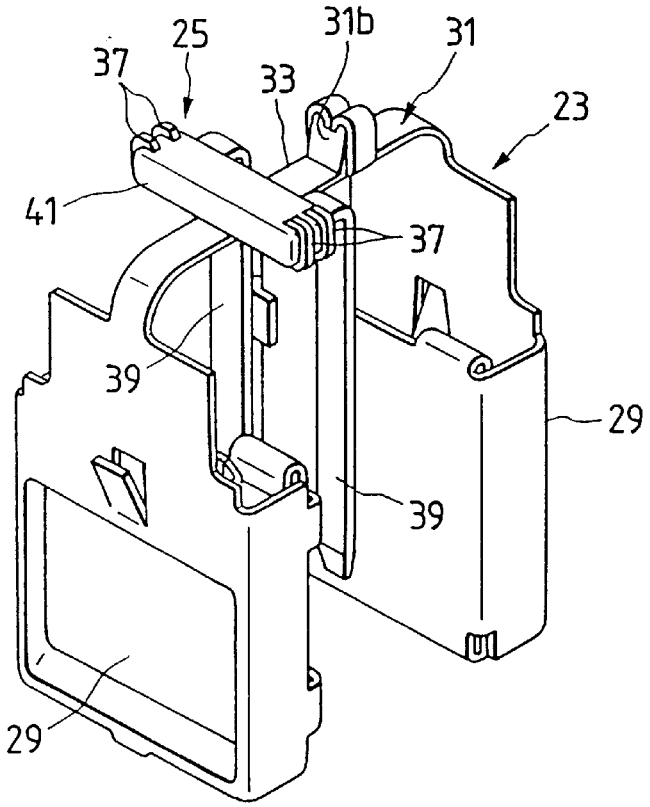
FIG. 2 is an enlarged perspective view showing the condition of mounting of the temperature fuse shown in FIG. 1.
Figure 3:
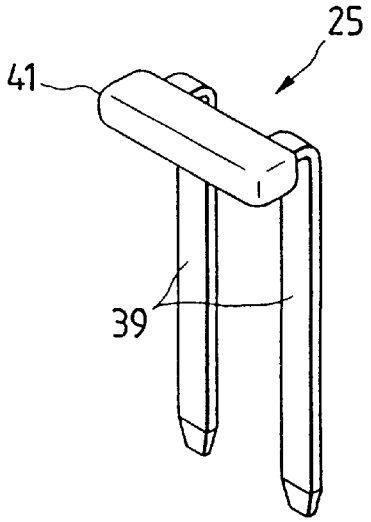
FIG. 3 is a perspective view of the temperature fuse shown in FIG. 2.
Figure 4:
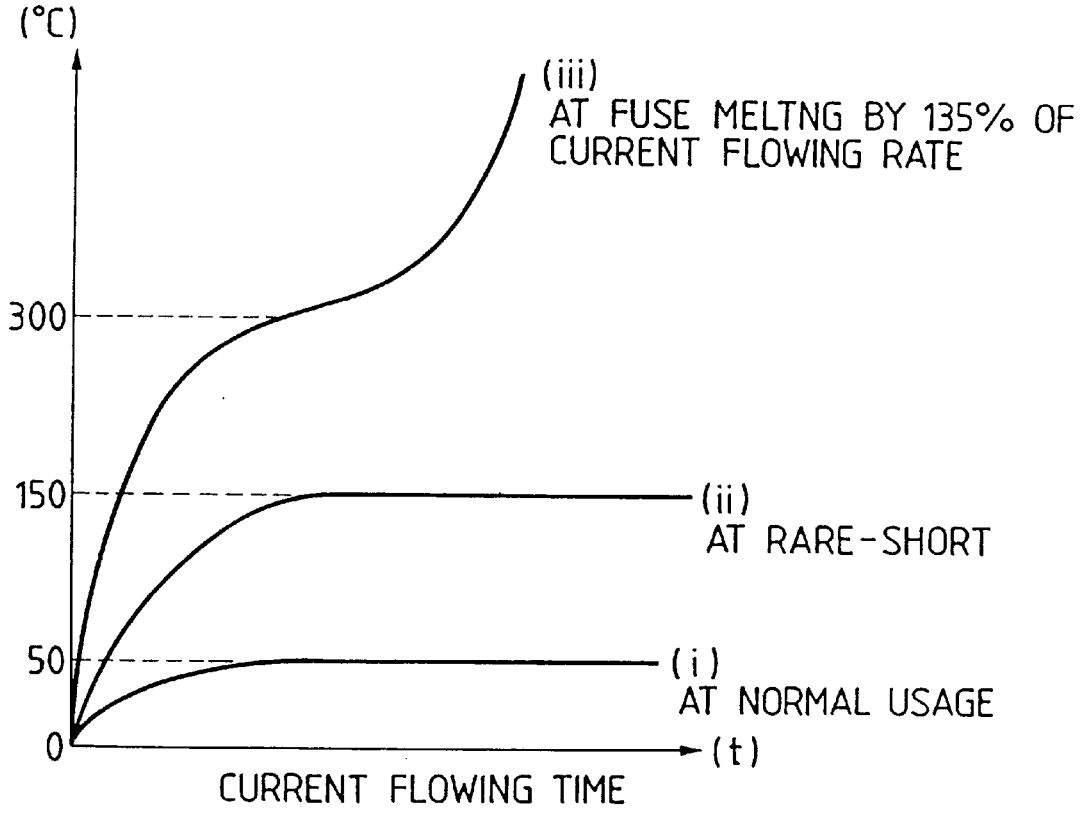
FIG. 4 is a graph explanatory of a temperature rise of a fuse element of a large-current fuse.
Figure 5:
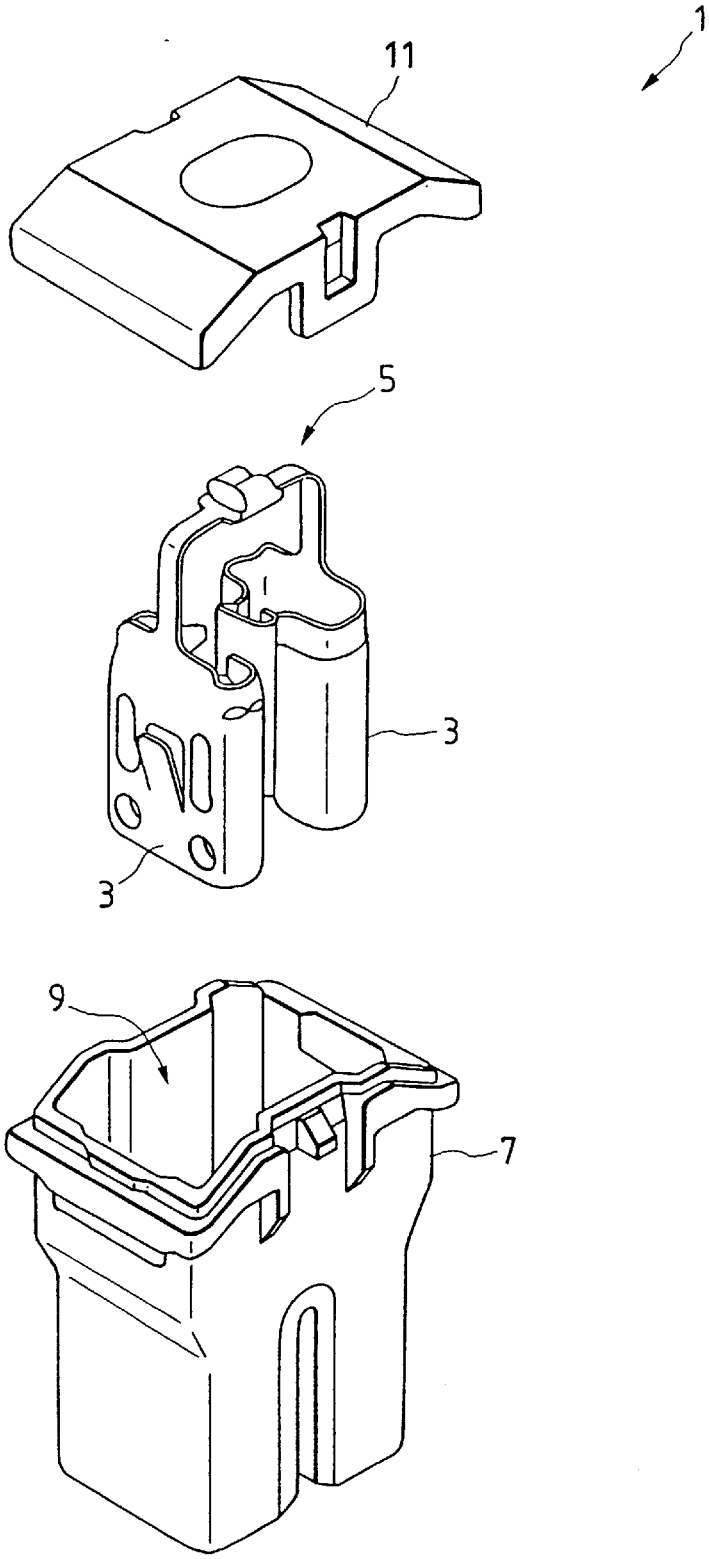
FIG. 5 PRIOR ART
FIG. 5 is an exploded perspective view of a conventional large-current fuse.
Figure 6:
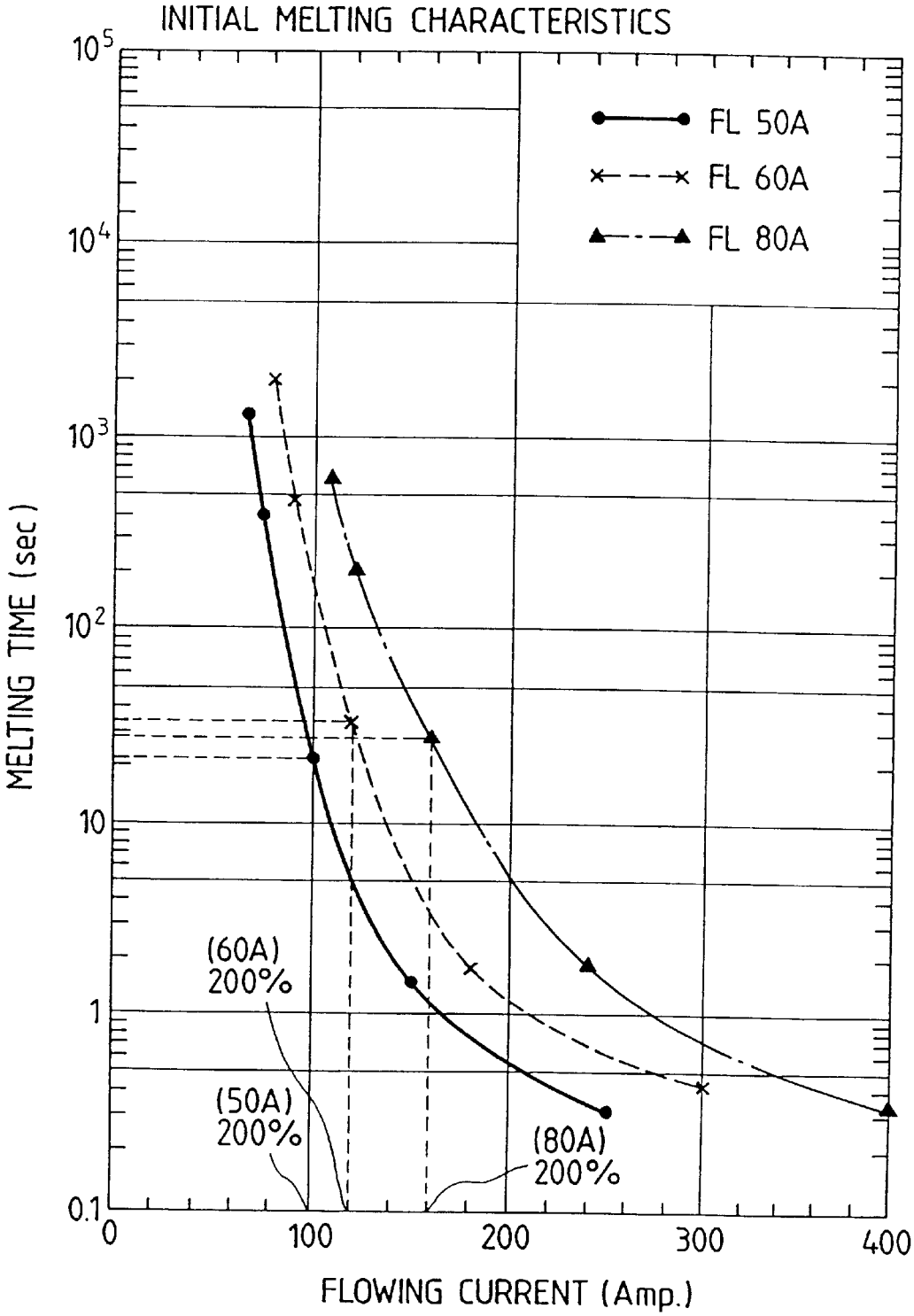
FIG. 6 PRIOR ART
FIG. 6 is a graph showing melting characteristics of the conventional large-current fuse.

FIG. 1 is a partly-broken side-elevational view of a large-current fuse unit of the invention, FIG. 2 is an enlarged perspective view showing the condition of mounting of a temperature fuse shown in FIG. 1, FIG. 3 is a perspective view of the temperature fuse shown in FIG. 2, and FIG. 4 is a graph explanatory of a temperature rise of a fuse element of a large-current fuse.

The large-current fuse unit 21 comprises a large-current fuse 23 to be operated by an excess current, a temperature fuse 25 to be operated in accordance with the ambient temperature, and a housing 27 holding these fuses 23 and 25 therein.

As shown in FIG. 2, the large-current fuse 23 comprises a pair of terminals 29 and 29, and a fuse element 31 interconnecting these terminals 29 and 29. The fuse element 31 has a fusible portion 33 made of low-melting point metal such as lead and tin, and this fusible portion 33 is melted by heat generated therein when an excess current flows between the two terminals 29 and 29, and the melting of the fusible portion 33 causes a circuit to be opened, thereby protecting a wire and an equipment.

Terminal receiving chambers (not shown) for respectively receiving the terminals 29 and 29, as well as an element receiving space 35 communicating with these terminal receiving chambers, are formed within the housing 27. When the terminals 29 and 29 are received respectively in the terminal receiving chambers, the fuse element 31 is positioned in the element receiving space 35.

The temperature fuse 25 is provided in the vicinity of the fuse element 31, and the temperature fuse 25 is retained on the fuse element 31, for example, by claws 37 extending from the fuse element 31. As shown in FIG. 3, the temperature fuse 25 comprises a pair of lead portions (male terminals) 39 and 39, and a temperature fuse element receiving portion (element receiving portion) 41 interconnecting these lead portions 39 and 39. An element (not shown) interconnecting the terminals 39 and 39, is received within the element receiving portion 41, and this element has a fusible portion which is melted with a predetermined temperature. The temperature fuse 25 is provided in such a manner that the element receiving portion 41 is disposed in close proximity to the fusible portion 33. In this embodiment, the element receiving portion 41 and the fuse element 31 intersect each other.

Therefore, the large-current fuse unit 21 has four poles or terminals, that is, the terminals 29 and 29 of the large-current fuse 23 and the terminals 39 and 39 of the temperature fuse 25. The terminals 29 and 29 of the large-current fuse unit 21 are received respectively in the terminal receiving chambers in the housing 27 while the terminals 39 and 39 of the temperature fuse 25 are exposed to the outside at a place, for example, between terminal receiving portions 43 and 43 of the housing 27.

The operating temperature of the temperature fuse 25 is set to a value lower than the operating temperature of the large-current fuse 23. Namely, the operating temperature of the temperature fuse 25 is set to a value between a maximum temperature, which can develop in a normally-used condition of the large-current fuse 23, and the operating temperature of the large-current fuse 23.

For example, as shown in FIG. 4, if the maximum temperature (i), which can develop in the normally-used condition of the large-current fuse 23, is 50° C., and its operating temperature (iii) is 300° C., the operating temperature of the temperature fuse 25 is set to a suitable value between 50 to 300° C.

Figure 1A:
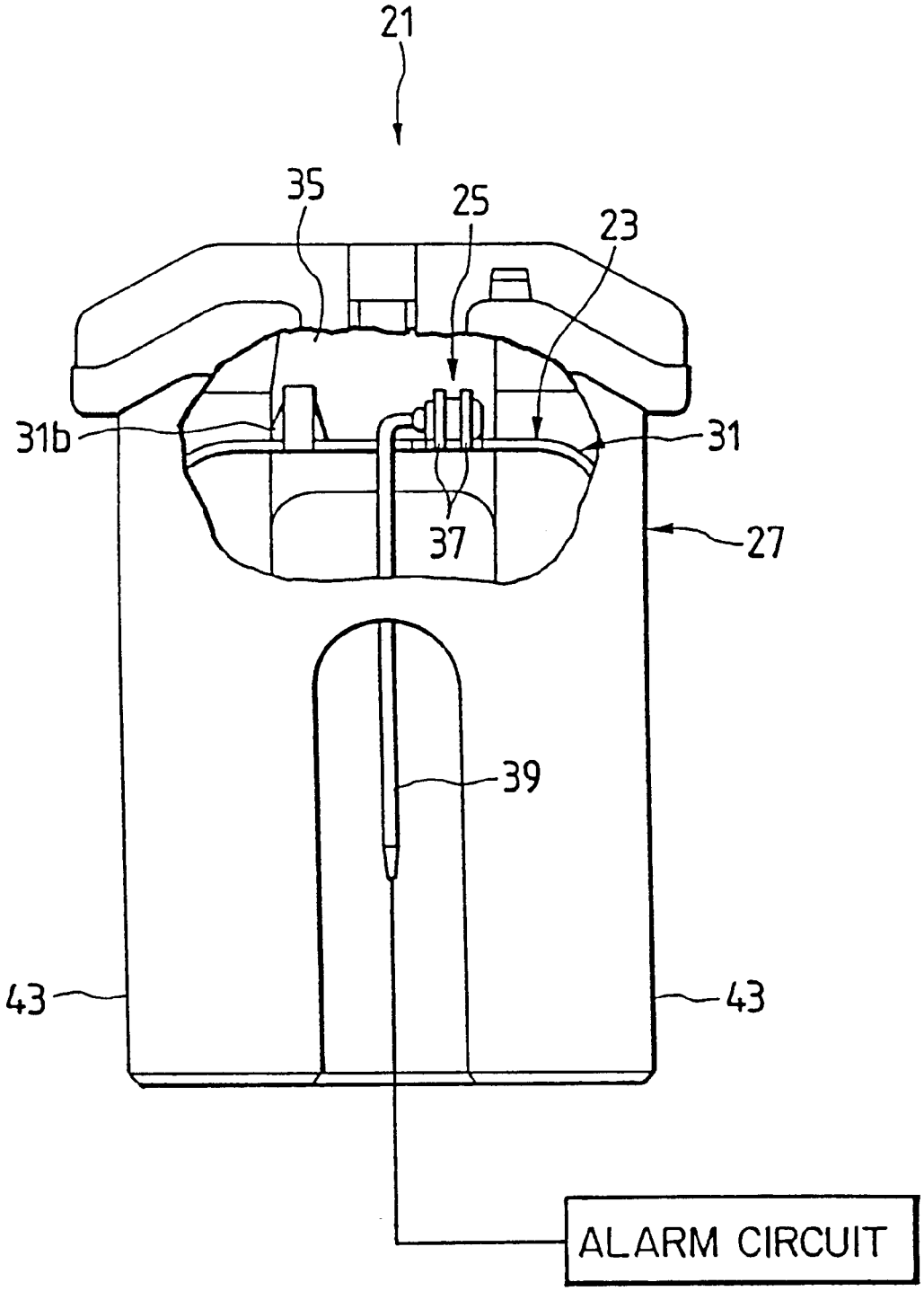

As shown in FIG. 1(A), the terminals 39 and 39 are connected to an alarm circuit for turning on an alarm lamp of a meter portion or the like, and when the fuse is melted, the alarm circuit is operated.

The operation of the large-current fuse unit 21 of this construction will now be described with reference to FIG. 4.

In the large-current fuse unit 21, usually, when the temperature of the fuse element 31 reaches about 300° C. as indicated at (iii) in FIG. 4, tin 31*b* begins to diffuse into a substrate of the fuse element, and thereafter the fusible portion 33 is melted. However, when discontinuous short-circuiting (rare short circuit) as indicated at (ii) occurs, the temperature of the fuse element 31 increases only to about 150° C., and therefore the large-current fuse 23 will not melt, or the melting time is very long.

Figure 1B:
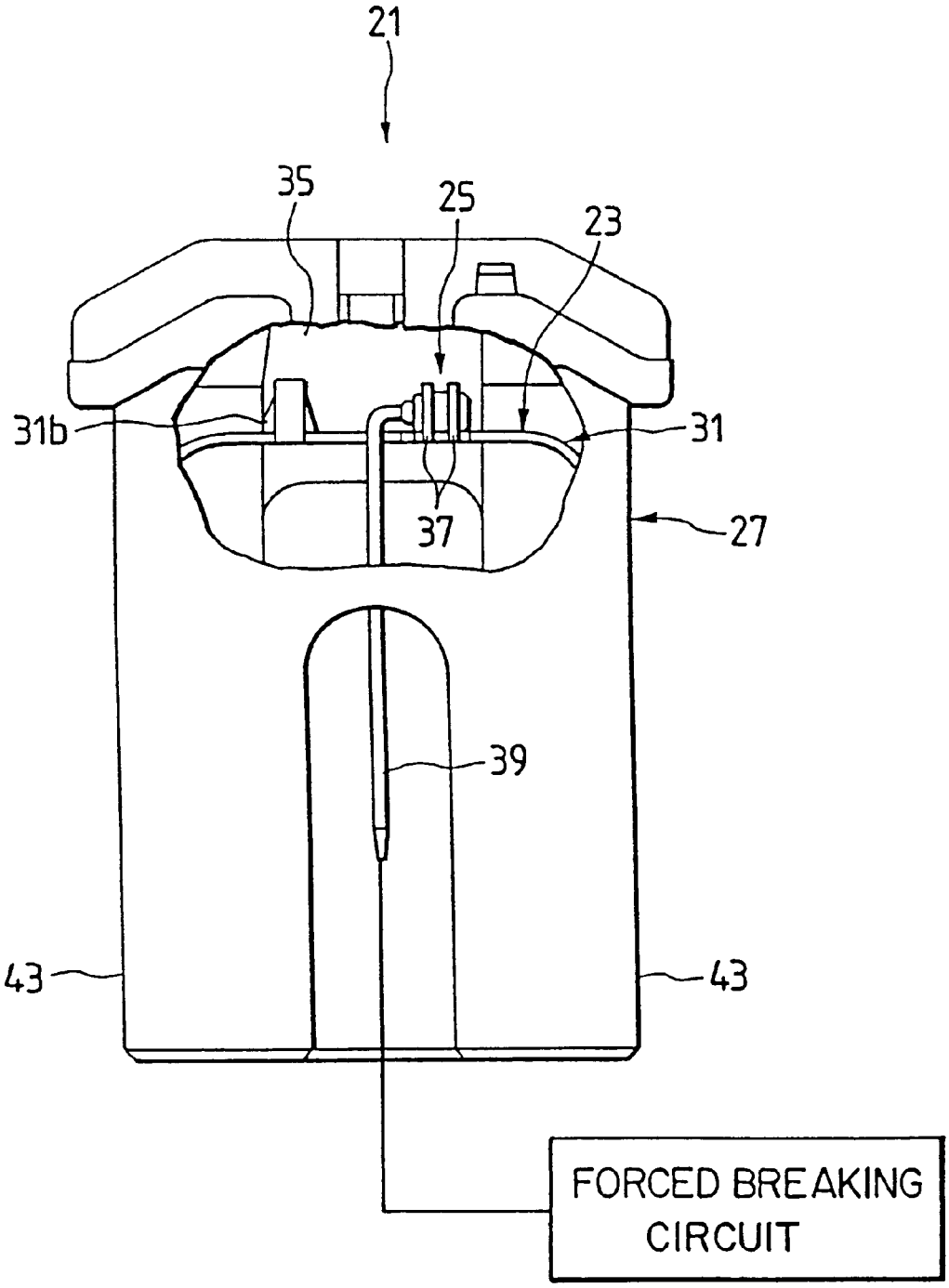

The operating temperature of the temperature fuse 25 is set to a value lower than 150°, and in this case, when such a rare short circuit occurs, the temperature fuse 25 melts, and in accordance with this melting signal, a forced breaking circuit (FIG. 1(B)) is driven to thereby break the circuit, or the alarm circuit (FIG. 1(A)) is operated to turn on the alarm lamp of the meter portion or the like, thus notifying the operator of the occurrence of the abnormal condition.

Thus, in the above large-current fuse unit 21, the temperature fuse 25, which is operated by the heat generated from the large-current fuse 23, is provided in the vicinity of this large-current fuse 23, and therefore even at the time of a rare short circuit when the large-current fuse 23 is not melted, the temperature fuse 25 is melted, so that the circuit is broken by this melting signal, or an alarm is given to the operator. As a result, the wire and the circuit can be protected from an abnormal current (which could not heretofore been interrupted in conventional large-current fuses) produced by discontinuous short-circuiting.

The temperature fuse 25 can be provided in the vicinity of the large-current fuse unit 21, using the housing 27 as used in a conventional fuse unit, and therefore the large-current fuse can be formed into a size generally equal to the present large-current fuse, and the functions of the current fuse and the temperature fuse can be packaged into one unit in a compact manner.

As described above in detail, in the large-current fuse unit of the present invention, the temperature fuse is provided in the vicinity of the large-current fuse, and the temperature fuse is melted by heat generated from the large-current fuse. Therefore, even if the large-current fuse is not melted, the circuit can be cut off, or the occurrence of the abnormal condition can be transmitted to the operator in accordance with this melting signal.

The operating temperature of the temperature fuse is set to a value between the operating temperature of the large-current fuse and the maximum temperature which can develop in the normally-used condition of the large-current fuse, and by doing so, the temperature fuse can be melted at the time of a rare short circuit when the large-current fuse is not melted, and therefore the wire and the circuit can be protected from an abnormal current (which could not heretofore been interrupted) due to such a rare short circuit.

What is claimed is:

1. A large-current fuse unit, comprising:

a large-current fuse including a pair of terminals, and a fuse element interconnecting said pair of terminals;

a housing receiving said large-current fuse therein; and a temperature fuse mounted in said housing, and being meltable by heat generated from said fuse element to open said temperature fuse;

wherein, during a normal operating condition, a current flowing through said large-current fuse does not flow through said temperature fuse.

2. A large-current fuse unit according to claim 1, wherein the melting of said temperature fuse one of activates an alarm circuit and activates a forced breaking circuit.

3. A large-current fuse unit according to claim 1, wherein an operating temperature of said temperature fuse is set to a value between an operating temperature of said large-current fuse and a maximum temperature which can develop in a normally-used condition of said large-current fuse.

4. A large-current fuse unit comprising:

a large-current fuse including a pair of terminals, and a fuse element interconnecting said pair of terminals;

a housing receiving said large-current fuse therein; and a temperature fuse mounted in said housing, and being meltable by heat generated from said fuse element;

wherein said temperature fuse includes a pair of lead portions, and an element receiving portion interconnecting said pair of lead portions, said element receiving portion being disposed to intersect said fuse element; and wherein the melting of said temperature fuse one of activates an alarm circuit and activates a forced breaking circuit.

5. A fuse unit comprising:

a housing;

a current fuse mounted in said housing; and a temperature fuse mounted in said housing, and being meltable by heat generated from said current fuse to open said temperature fuse;

wherein, during a normal operating condition, a current flowing through said current fuse does not flow through said temperature fuse.

6. A fuse unit according to claim 5, wherein the melting of said temperature fuse one of activates an alarm circuit and activates a forced breaking circuit.

7. A large-current fuse unit according to claim 5, wherein an operating temperature of said temperature fuse is set to a value between an operating temperature of said current fuse and a maximum temperature which can develop in a normally-used condition of said current fuse.

8. A fuse unit comprising:

a housing;

a current fuse mounted in said housing; and a temperature fuse mounted in said housing, and being meltable by heat generated from said current fuse to open said temperature fuse;

wherein, during a normal operating condition, said current fuse and said temperature fuse are not electrically coupled together.

9. A fuse unit according to claim 8, wherein the melting of said temperature fuse one of activates an alarm circuit and activates a forced breaking circuit.

10. A large-current fuse unit according to claim 8, wherein an operating temperature of said temperature fuse is set to a value between an operating temperature of said current fuse and a maximum temperature which can develop in a normally-used condition of said current fuse.

* * * * *